US007112088B2

(12) United States Patent
Zhang et al.

(10) Patent No.: US 7,112,088 B2
(45) Date of Patent: Sep. 26, 2006

(54) CONNECTOR FOR FLEXIBLE PRINTED CIRCUIT

(75) Inventors: Chi Zhang, Kunsan (CN); Ren-Chih Li, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 11/120,600

(22) Filed: May 2, 2005

(65) Prior Publication Data

US 2006/0030205 A1 Feb. 9, 2006

(30) Foreign Application Priority Data

Aug. 5, 2004 (CN) ..... 2004 2 0078462

(51) Int. Cl.
*H01R 12/24* (2006.01)

(52) U.S. Cl. ..... 439/495; 439/496

(58) Field of Classification Search ..... 439/495, 439/496

See application file for complete search history.

(56) References Cited

U.S. PATENT DOCUMENTS 3,569,909 A * 3/1971 Garver ..... 439/353
5,688,143 A * 11/1997 McHugh et al. ..... 439/495
5,816,845 A 10/1998 Chishima et al.
6,004,156 A * 12/1999 Roque et al. ..... 439/495
6,206,723 B1 * 3/2001 Kunishi ..... 439/495
6,254,406 B1 * 7/2001 Chiu et al. ..... 439/142
6,508,661 B1 * 1/2003 Yu ..... 439/495
6,517,367 B1 * 2/2003 Yamane ..... 439/260
6,551,128 B1 * 4/2003 Asai ..... 439/495
6,561,843 B1 * 5/2003 Ma et al. ..... 439/495
2002/0013086 A1 * 1/2002 Inoue ..... 439/495

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

An connector (100) for a flexible printed circuit (FPC) includes a first housing (1) having a tongue plate (12), a pair of arms (13) disposed beside the tongue plate respectively, and retention spaces (16) defined between the tongue plate and each arm; a second housing (4) movably assembled to the first housing, and having two opposite sidewalls (45) and a bottom wall between the sidewalls, the bottom wall facing the tongue plate to form a cavity therebetween for receiving the FPC (6), the sidewall configured to slide into the retention space to be retained therein with an upper surface and an under surface thereof exposed to exterior; and terminals arranged in the cavity to engage with the FPC.

10 Claims, 6 Drawing Sheets

CONNECTOR FOR FLEXIBLE PRINTED CIRCUIT

BACKGROUND OF THE INVENTION

1. Field of the Invention

The present invention relates to an electrical connector, and more particularly to an electrical connector for a sheet-like connection member such as a flexible printed circuit or cable (FPC), a flexible flat cable (FFC) and so forth. All of these cables and circuit will be generally referred to as "FPC". The instant application relates to a contemporaneously filed application having the same title, the same applicant and the same assignee with the invention.

2. Description of Related Art

U.S. Pat. No. 5,816,845 discloses a connector for a FPC comprising a stationary housing defining a cavity with an insertion port through which the FPC is inserted into the cavity; metal terminals mounted on the housing and inserted into the cavity; and a slide housing displaceable relative to the housing between a completely-retained position and a provisionally-retained position. When the FPC is to be inserted into the cavity, the slide housing is displaced to the provisionally-retained position to be held in a stand-by position outwardly of the insertion port. After the FPC is inserted into the cavity, the slide housing is also inserted into the cavity to the completely-retained position, to hold the metal terminals in contact with the FPC. In addition, the stationary housing has a pair of U-shaped frame respectively at its lengthwise sides. Each frame comprises an upper flange, a lower flange, and a guide groove between the upper flange and the lower flange for guidingly receiving an arm of the movable housing to retain the movable housing on the stationary housing. The groove has a vertical size between the upper flange and the lower flange substantially equal to the thickness of the arm.

As the requirement of minimization of electrical components is ever increasing, it is desired to decrease the thickness of the connector. However, for preventing the arm of the movable housing from snapping, we should not decrease the thickness of arm to achieve that purpose. Thereby we can only decrease the thickness of the upper flange and the lower flange, but which will weaken the flanges. Otherwise, such a connector requires the stationary housing to provide a sufficient size of height to define a cavity to receive the FPC and the slide housing.

Thereby, to meet the ever-increasing requirement of minimization of electrical components, a connector with a lower profile for FPC is desired.

SUMMARY OF THE INVENTION

An object of the present invention is to provide an electrical connector that is decreased in size of height for a FPC.

A second object of the present invention is to provide an electrical connector, parts of which are firmly assembled against accidental separating.

Accordingly, to achieve the above object, a connector of present invention includes a first housing having a tongue plate, a pair of arms disposed beside the tongue plate respectively, and retention spaces defined between the tongue plate and each arm; a second housing movably assembled to the first housing, and having two opposite sidewalls and a bottom wall between the sidewalls, the bottom wall facing the tongue plate to form a cavity therebetween for receiving the FPC, the sidewall configured to slide into the retention space to be retained therein with an upper surface and an under surface thereof exposed to exterior; and terminals arranged in the cavity to engage with the FPC.

Other objects, advantages and novel features of the present invention will become more apparent from the following detailed description of the present embodiment when taken in conjunction with the accompanying drawings.

DETAILED DESCRIPTION OF THE INVENTION

Figure 1:
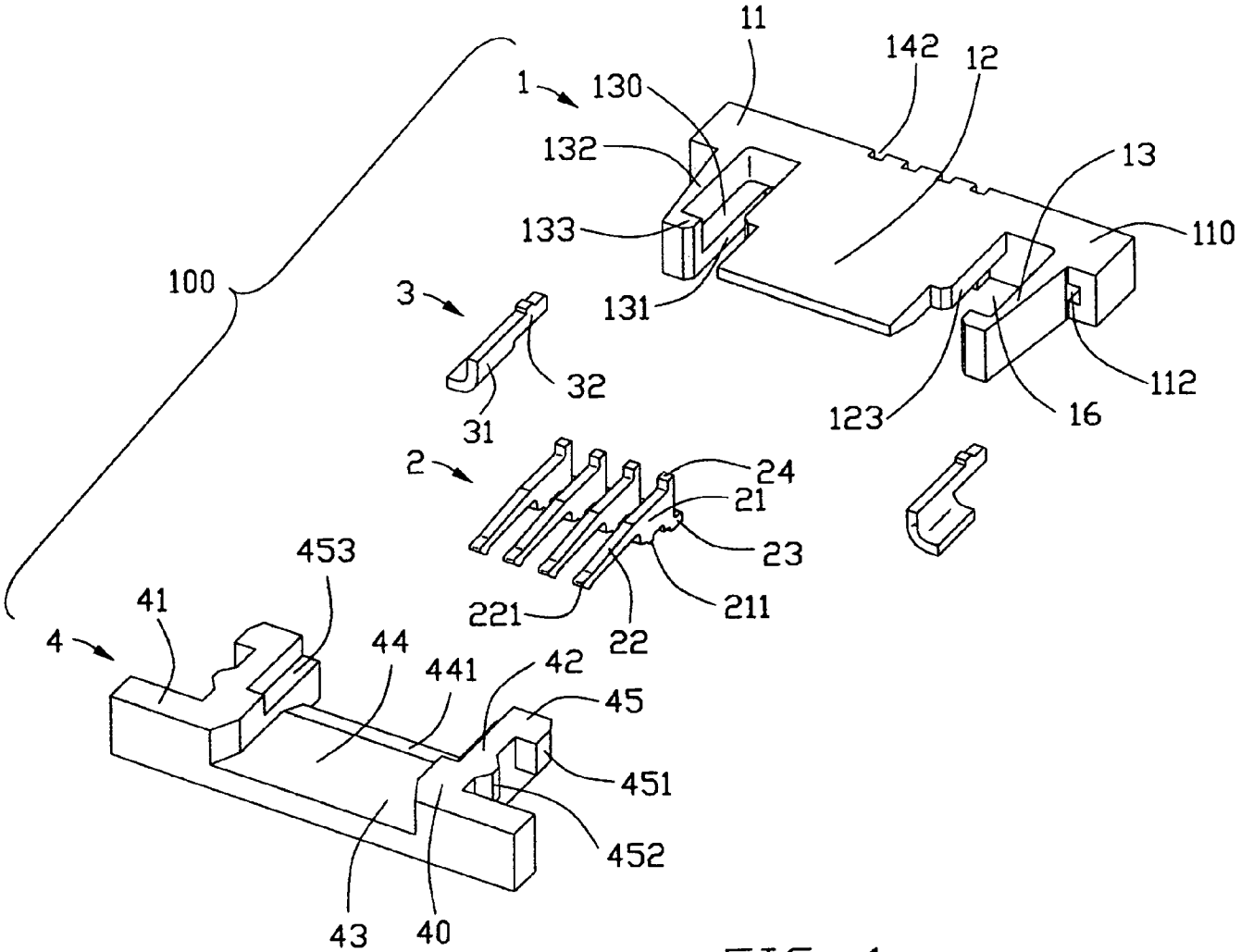
FIG. 1 is an exploded view of a connector of the present invention.

Reference will now be made to the drawing figures to describe the present invention in detail.

Figure 2:
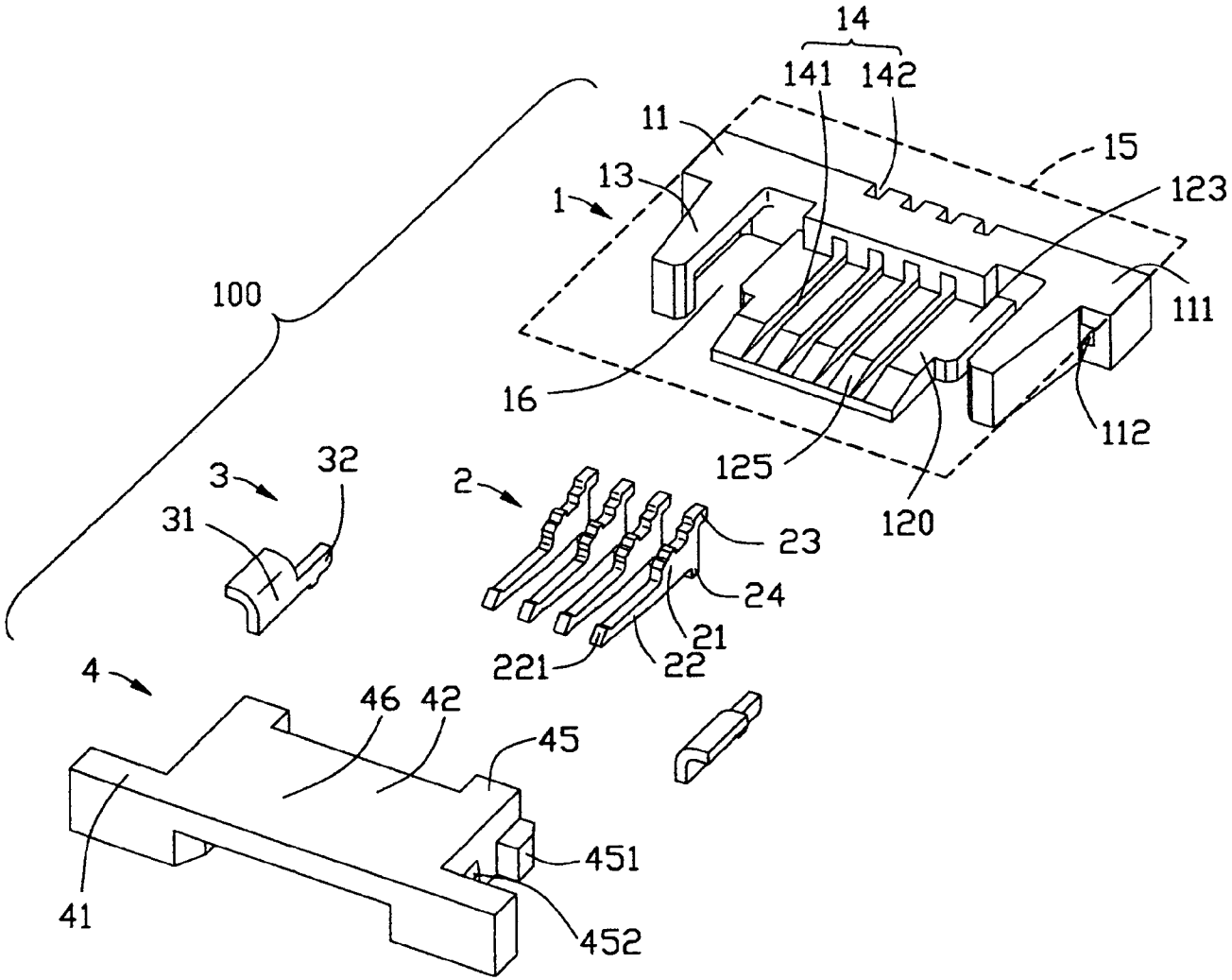
FIG. 2 is an exploded view of the connector of FIG. 1 but taken from reversed aspect.

Referring to FIGS. 1 and 2, the connector 100 of the present invention comprises a stationary housing 1, terminals 2 to be arranged in the stationary housing 1, retainers 3, and a movable housing 4.

Figure 5:
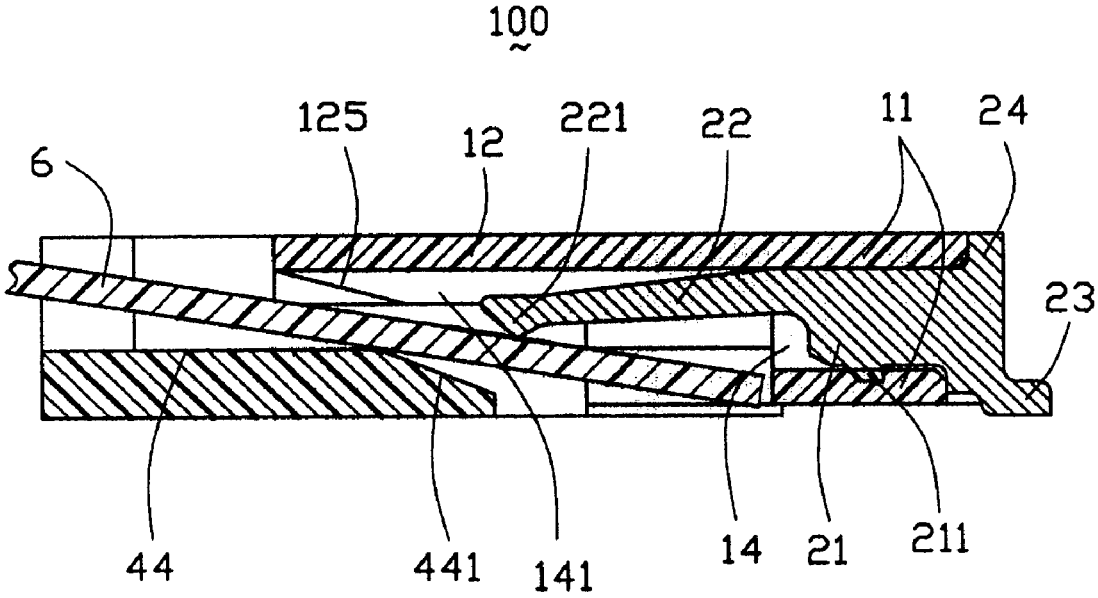
FIG. 5 is a cross-sectional view taken along line 5—5 of FIG. 3.

The stationary housing 1 has a lengthwise body portion 11, a tongue plate 12 breadthwise extending from the body portion 11 with its upper surface flush with an upper surface 110 of the body portion 11, and a pair of arms 13 oppositely beside the tongue plate 12 and extending from the body portion 11 with its upper surface and under surface respectively flush with the upper surface 110 and under surface 111 of the body portion 11. The under surface 111 of the body portion 11 defines a suppositional mounting face 15 for mounting on a printed circuit board (PCB) (not shown). The tongue plate 12 has a first mating surface 120 facing the mounting face 15 with a vertical distance therebetween and defines a plurality of interior slots 141 on the first mating surface 120. Each interior slot 141 extends breadthwise throughout the body portion 11 to communicating a respective exterior slot 142 defined along a vertical direction, to form a unitary aperture 14 to receive the terminals 2. Additionally, the tongue plate 12 is trimmed to form a shortened edge 123. The first mating surface 120 inclines at that end remote from the body portion 11 to form a first slant 125, as best shown in FIG. 5. The arm 13 defines a recess 130 opening up and communicating with a space 16 between the arm 13 and the tongue plate 12.

The terminal 2 comprises a retention portion 21, an elastic arm 22 extending from one end of the retention portion 21, a solder tail 23 and a stop tail 24 respectively extending down and up from the other end of the retention portion 21. The elastic arm 22 has a contact portion 221 at the end thereof. The retention portion 21 has a retain leg 211 protruding downwards to be retained in the body portion 11 of the stationary housing 1.

Referring to FIG. 5 together, the terminal 2 is inserted into the aperture 14 from the exterior slot 142 with its elastic arm 22 received in the interior slot 141 and protruding towards the mounting face 15. The stop tail 24 is blocked in the exterior slot to stop the terminal 2 from moving ahead. The solder tail 23 is to be soldered to the PCB.

The retainers 3 each comprise an elbow 31 to be soldered to the PCB, and a leg 32 to be fixed into a hole 112 in the stationary housing 1 adjacent to the outside of the arm 13 (shown in FIG. 1). Thus the retainers 3 retain stationary housing 1 to the PCB to prevent the tongue plate 12 thereof from turning up during insertion of a FPC or the movable housing 4.

The movable housing 4 being of a "T" shape comprises a lengthwise body portion 41 and a mating portion 42 perpendicularly extending from the body portion 41, and is cut from an upper surface 40 thereof to define a passage 43 therein extending along a breadthwise direction throughout the body portion 41 and the mating portion 42. That bottom surface 44 of the passage 43 functions as a second mating surface and sidewalls 45 of the passage 43 function as slide legs. The second mating surface 44 declines at that end remote from the body portion 41 to form a second slant 441. Each slide leg 45 has a first slide block 451 and a second slide block 452 spaced protruding from its outer side, and defines a notch 453 by its inner side to engage the shortened edge 123 while the slide leg 45 is sliding into the space 16 of the stationary housing 1.

The movable housing 4 is assembled to the stationary housing 1 with an under surface 46 thereof sliding along the mounting face 15. Meanwhile the slide leg 45 slides into the space 16 with the slide blocks 451,452 thereof being forced into the recess 130 in succession, and the notch 453 thereof fittingly engaging the shortened edge 123. Thus the slide blocks 451,452 are hold in the recess 130 by a bottom flange 131 thereof, to prevent the movable housing 4 from dropping down. The engagement of the notch 453 and the shortened edge 123 stops the movable housing 4 from moving up, thereby to keep a space between first mating surface 120 and the second mating surface 44 to form a cavity for receive the FPC. Otherwise, as the slide blocks 451,452 are hold in the recess 130, and are stopped from sidewalking by a side flange 132 thereof, from overly advancing by the body portion 11 exposed in the recess 130 and acting as an end flange, and from withdrawing by another end flange 133 thereof, the slide leg 42 therefore is retained in the space 16.

Figure 3:
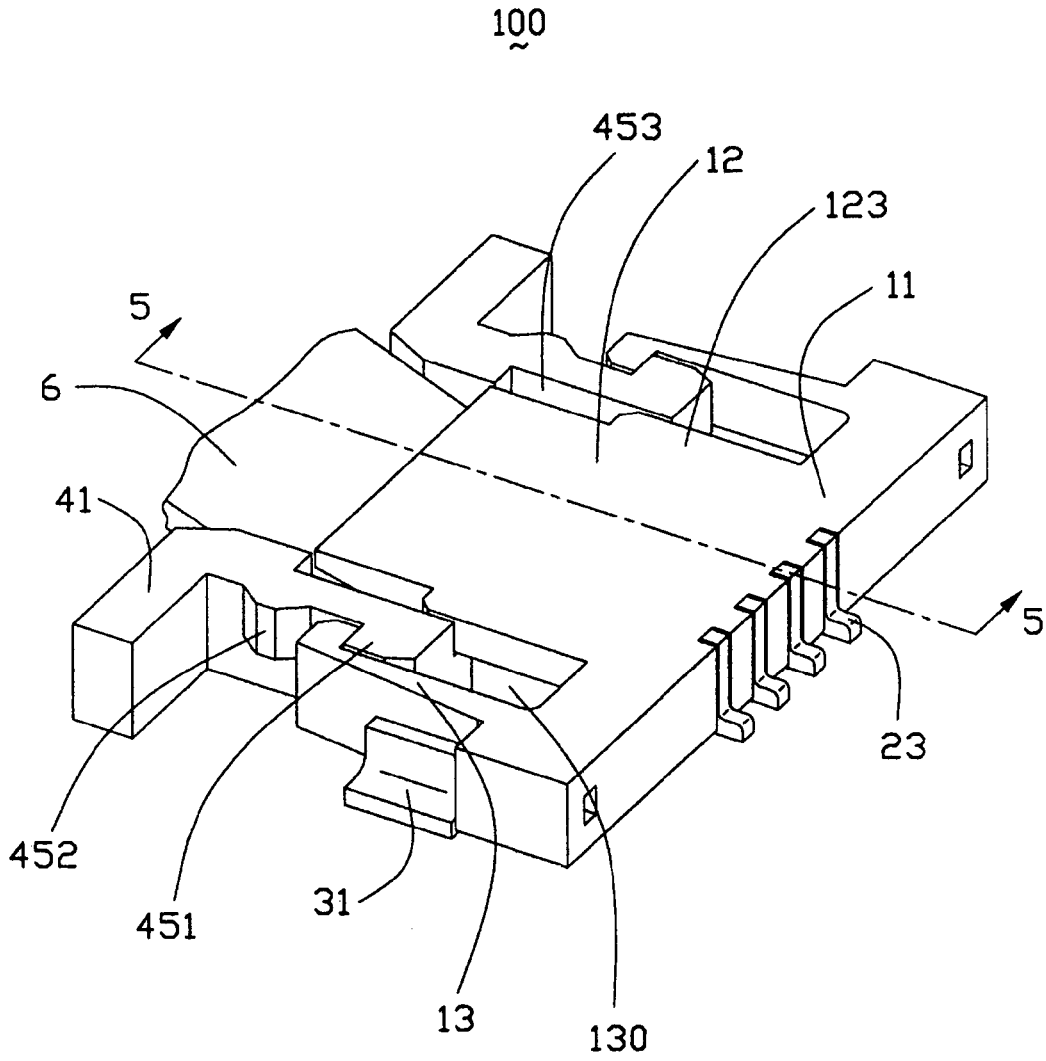
FIG. 3 is an assembled view of the connector of the present invention, showing a movable housing in a provisionally-retained position relative to a stationary housing of the connector and a FPC being aslant inserted into the connector.
Figure 4:
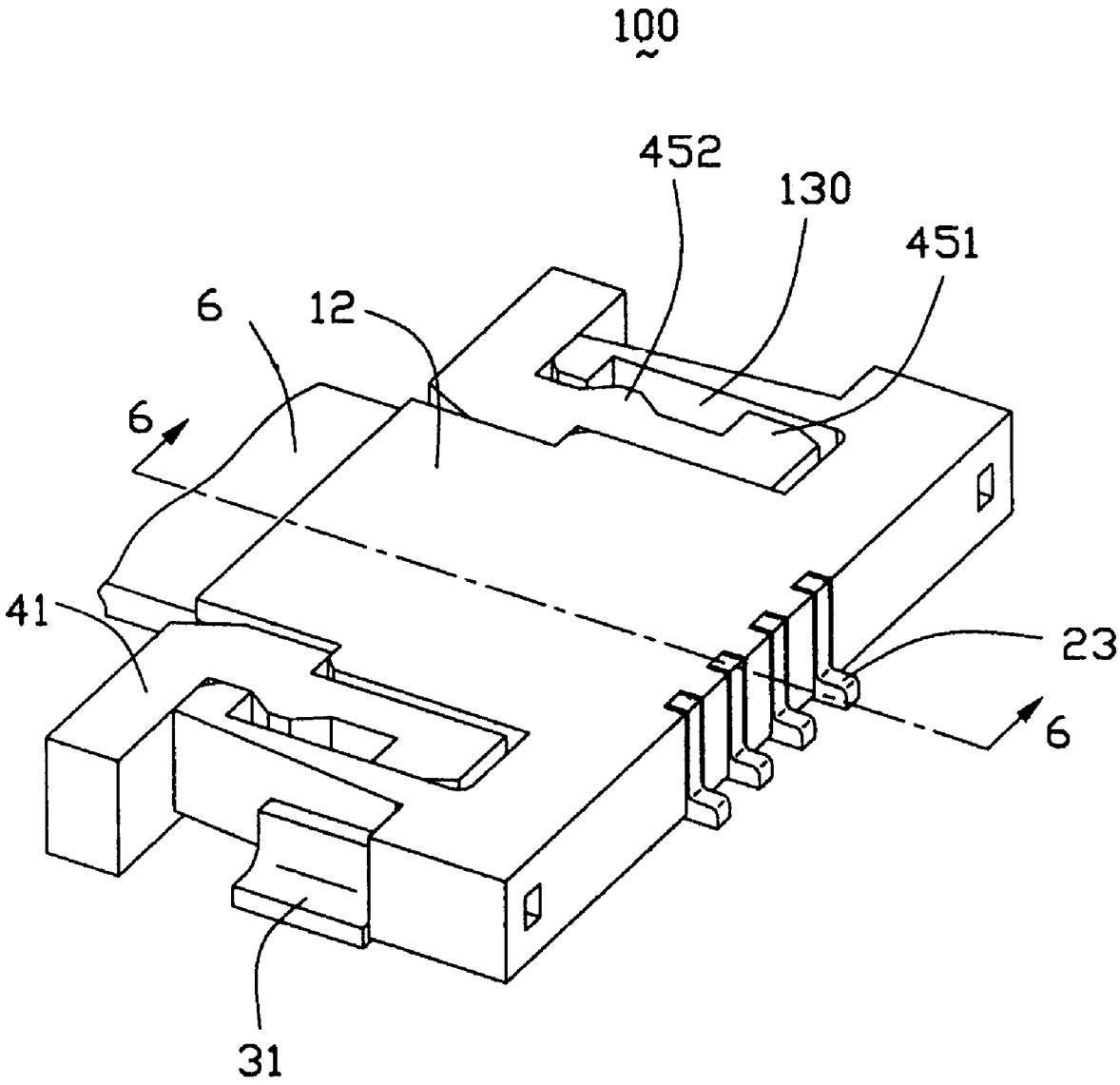
FIG. 4 is an assembled view of the connector of the present invention, showing the movable housing in a completely-retained position relative to the stationary housing of the connector, wherein the FPC has been urged to contact terminals in the stationary housing.

The movable housing 4 has a size of height equal to that of the stationary housing 1 as a whole. Thus the slide leg 45 in the space 16 is upwards and downwards exposed to exterior, making the upper surface and the under surface of the movable housing 4 be flush with that of the stationary housing 1, as shown in FIG. 3 or 4. That effectively retrenches the whole height of the connector 100. Again, since the PCB is instead of a bottom wall of the stationary housing 1 to form a room for receiving the FPC 6 and the movable housing 4 together with the tongue plate 12, a height size of the bottom wall is saved on the stationary housing 1, which also decreases the whole height of the stationary housing 1.

Referring to FIGS. 3 and 5, when the first slide block 451 is forced into the recess 451 but the second slide block 452 is still left out, the movable housing 4 is located in a provisionally-retained position relative to the stationary housing 1. At this time, the second slant 441 of the second mating surface 44 is brought into being parallel to the first slant 125 of the first mating surface 120 to form a slantwise insertion-port for guiding a FPC 6 to enter into the cavity between the first mating surface 120 and the second mating surface 44. Thus the FPC 6 is aslant inserted through the insertion-port with a zero insertion force. As a result of the insertion of the movable housing 4 or the FPC 6, the tongue plate 12 of the stationary housing 1 would be turned up if the stationary housing 1 is attached to the PCB only by the terminals 2 therein being soldered to the PCB. However, the existence of the retainers 3 further retains stationary housing 1 to the PCB against turning up of the tongue plate 12.

Figure 6:
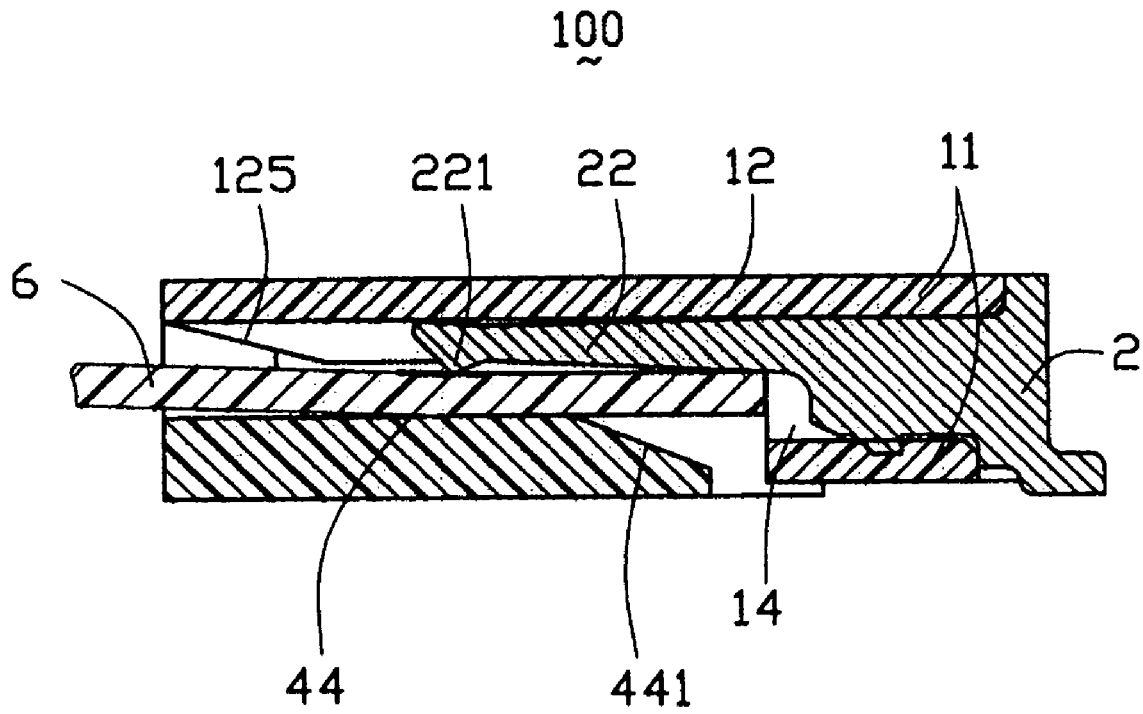
FIG. 6 is a cross-sectional view taken along line 6—6 of FIG. 4.

After the FPC 6 is inserted into the cavity, the movable housing 4 is further inserted towards the stationary housing 1, and the second slide block 452 is also forced into the recess 130. Now the movable housing 4 is in a completely-retained position, as shown in FIGS. 4 and 6. The second mating surface 44 of the advancing movable housing 4 urges the FPC 6 to rotate from the slanting state to a flat state to tightly contact the contact portions 221 of the terminals 2. That ensures electrical connection between conductors of the FPC 6 and the terminals 2.

Therefore, by such a design, an electrical connector with a lower profile for FPC is provided. However, the disclosure is illustrative only, changes may be made in detail, especially in matter of shape, size, and arrangement of parts within the principles of the invention.

What is claimed is:

1. A connector for a flexible printed circuit (FPC) comprising:

a first insulative housing having an upper tongue plate and a pair of first arms respectively disposed beside and spaced from the upper tongue plate along a longitudinal direction; and a second insulative housing assembled to the first housing and movable relative to the first housing along a front-to-back direction perpendicular to said longitudinal direction, said second housing having a lower bottom wall and a pair of second arms respectively beside the lower bottom wall, said lower bottom wall being vertically overlapped under the upper tongue plate, and each of said second arms engaging with the first arm and a lateral edge of the upper tongue plate for preventing relative movement between the first and second housings along a vertical direction perpendicular said longitudinal and front-to-back directions, wherein the first arm defines a first recess and the second arm provides a bulge portion for engaging with the first recess, and the second arm defines a second recess for engaging with the lateral edge of the upper tongue plate.

2. The connector as described in claim 1, wherein a plurality of terminals disposed in the first housing.

3. The connector as described in claim 1, wherein the upper tongue plate defines a cutout along the lateral edge adjacent a front edge thereof.

4. The connector as described in claim 1, wherein the bulge portion includes two protuberances spaced along said front-to-back direction.

5. The connector as described in claim 1, wherein a cross-section of the second arm around an engagement region with said upper tongue plate and said first arm, is of a Z-like configuration so as to engage upwardly the corresponding upper tongue plate and downwardly the corresponding first arm, respectively.

6. A connector for a flexible printed circuit (FPC) comprising:

a first insulative housing having an upper tongue plate and a pair of first arms respectively disposed beside and spaced from the upper tongue plate along a longitudinal direction; and a second insulative housing assembled to the first housing and movable relative to the first housing along a front-to-back direction perpendicular to said longitudinal direction, said second housing having a lower bottom wall and a pair of second arms respectively beside the lower bottom wall, said lower bottom wall being vertically overlapped under the upper tongue plate, and each of said second arms sandwiched between the upper tongue plate and the first arm both along the longitudinal direction and a vertical direction perpendicular to the longitudinal and front-to-back directions for preventing relative movement between the first and second housings along the longitudinal or vertical direction, wherein the first arm defines a first recess and the second arm provides a bulge portion for engaging with the first recess, and the second arm defines a second recess for engaging with a lateral edge of the upper tongue plate.

7. The connector as described in claim 6 wherein a plurality of terminals disposed in the first housing.

8. The connector as described in claim 6, wherein the upper tongue plate defines a cutout along the lateral edge adjacent a front edge thereof.

9. The connector as described in claim 6, wherein the bulge portion includes two protuberances spaced along said front-to-back direction.

10. The connector as described in claim 6, wherein a cross-section of the second arm around an engagement region with said upper tongue plate and said first arm, is of a Z-like configuration so as to engage upwardly the corresponding upper tongue plate and downwardly the corresponding first arm, respectively.

* * * * *